United States Patent [19]

Leslie

[11] 4,084,474

[45] Apr. 18, 1978

[54] SELECTIVE HIGH FREQUENCY COMPRESSION DEVICE FOR SPEAKER SYSTEM

[76] Inventor: Donald James Leslie, 1561 Gaywood Dr., Altadena, Calif. 91001

[21] Appl. No.: 655,106

[22] Filed: Feb. 4, 1976

[51] Int. Cl.[2] ..... G10H 1/00; G10H 5/00

[52] U.S. Cl. ..... 84/1.27; 84/1.03; 84/DIG. 1; 179/1 G; 179/1 VL; 340/228 R

[58] Field of Search ..... 84/1.03, 1.09, 1.1, 84/1.27, 464, DIG. 1, DIG. 27; 179/1 G, 1 GA, 1 M, 1 VL; 317/41; 340/228 R

[56] References Cited

U.S. PATENT DOCUMENTS

| | | | |
|---|---|---|---|
| 2,904,632 | 9/1959 | Levy | 179/1 G |
| 3,707,594 | 12/1972 | Ichikawa | 84/1.03 |
| 3,708,602 | 1/1973 | Hiyama | 84/1.03 |
| 3,818,115 | 6/1974 | Hirano | 84/DIG. 1 |
| 3,935,511 | 1/1976 | Boulanger et al. | 317/41 X |
| 3,943,411 | 3/1976 | Huszty et al. | 317/41 X |

*Primary Examiner*—Stanley J. Witkowski
*Attorney, Agent, or Firm*—Flam & Flam

[57] ABSTRACT

A multiband speaker system means includes a high frequency section normally balanced with one or more lower freqency sections. A thermistor is serially associated only with the high frequency section whereby, for certain high power signal combinations, a lesser proportionate increase in output occurs in the high frequency section than the low frequency section. This not only makes possible a lower power rating, but also eliminates certain effects that are not musically desirable.

3 Claims, 2 Drawing Figures

SELECTIVE HIGH FREQUENCY COMPRESSION DEVICE FOR SPEAKER SYSTEM

FIELD OF INVENTION

This invention relates to multiband speaker systems such as for use with electronic organs.

DISCUSSION OF PRIOR ART

Amplified output signals from an electronic organ or the like are typically applied to a divider network with a crossover frequency of 3000 Hz or 4000 Hz. The high frequency or tweeter section connected directly to the network output may be damaged by certain combinations of signals. Thus, for example, the manual section of an organ may produce high frequency signals that happen to reinforce high frequency signals produced by an automatic section such as a rhythm unit. High frequency sections can be designed to handle high power, but the extra output may not be musically desirable. High power handling capabilities are usually desirable only for the low frequency section or sections. A series resistance device in series with the high frequency section will change the high-low balance for all power levels whereas the balance is desirably maintained only at low and medium power levels.

SUMMARY OF INVENTION

In order to achieve the appropriate shift in high-low balance only at high output levels, I provide a thermistor serially associated only with the high frequency section. The thermistor has a low thermal inertia characteristic so that it quickly returns to a low resistance state corresponding to the tempo of a typical musical composition. With this arrangement, powerful low frequency sections can be used with a small and inexpensive high frequency speaker. The combination of speaker sections will operate in the desired high-low balance at medium and low output levels, with a change in response occuring only in the high frequency section only during high output levels.

BRIEF DESCRIPTION OF DRAWINGS

A detailed description of the invention will be made with reference to the accompanying drawing wherein like numerals designate corresponding parts in the figure.

DETAILED DESCRIPTION OF PREFERRED EMBODIMENT

Figure 1:
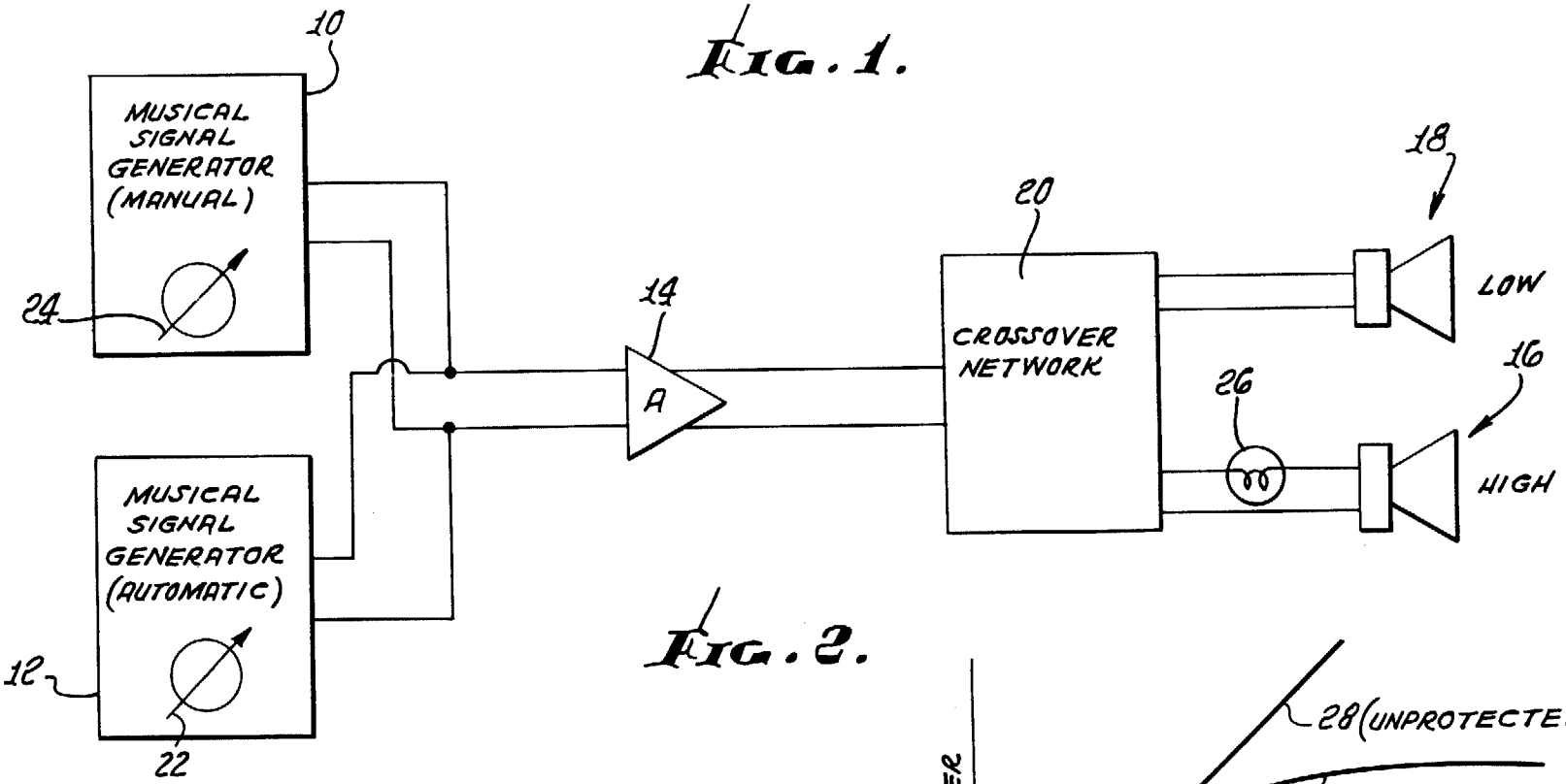
FIG. 1 is a diagrammatic view of the selective high frequency compression device.

The following detailed description is of the best presently contemplated mode of carrying out the invention. This description is not to be taken in a limiting sense, but is made merely for purposes of illustrating the general principles of the invention since the scope of the invention is best defined by the appended claims.

In the drawing, there is illustrated by way of example, a musical instrument comprising an automatic section and a manual section such as a keyboard operated unit 10 and a rhythm unit 12. Both may provide signals simultaneously that are amplified by a power amplifier 14.

The amplified signals are translated into sound by a multiband speaker system diagrammatically illustrated as a high frequency section 16 and a low frequency section 18. Either section 16 or 18 may be a composite. Furthermore the band may be separated into more than two sections. The frequency band is divided in this example into two sections by a crossover network 20 having separate outputs for the sections 16 and 18.

The instantaneous signal amplitude of the generator sections 10 and 12 is determined by the combination of the outputs of both. The automatic section may produce periodic high frequency power peaks. The overall amplitude is also controllable by an adjustment knob diagrammatically illustrated at 22. The manual section may also produce high frequency power peaks with overall amplitude controlled by the usual swell pedal diagrammatically illustrated at 24. The instantaneous composite peaks at any spectral range may be substantial. Ordinarily, the low frequency speaker section 18 is designed to accommodate substantial power. But the high frequency section 16 may not be capable of handling the very high composite peaks generated by the chance in-phase relationship of the two generator units. For usual spectral distributions and usual levels of power, no overload possibilities occur. However, with certain combinations of operation of the automatic and manual sections, high levels may be encountered. To limit power to the high frequency speaker section 16, a thermistor 26 is provided that is serially interposed between the output of network 20 and the section 16.

At usual current levels, the heat dissipation characteristic of the thermistor 26 is such that its circuit resistance is small. Instantaneous high power signal levels cause the thermistor to heat and thus to reduce the proportion of power dissipated in the high frequency section. The speaker is thus protected. The thermal inertia characteristic of the thermistor is very low in order to match the tempo of the music. Thus, for example, at the high output levels, the resistance may reduce to half in a tenth or twentieth of a second. The system balance for low power levels is thus quickly restored.

Figure 2:
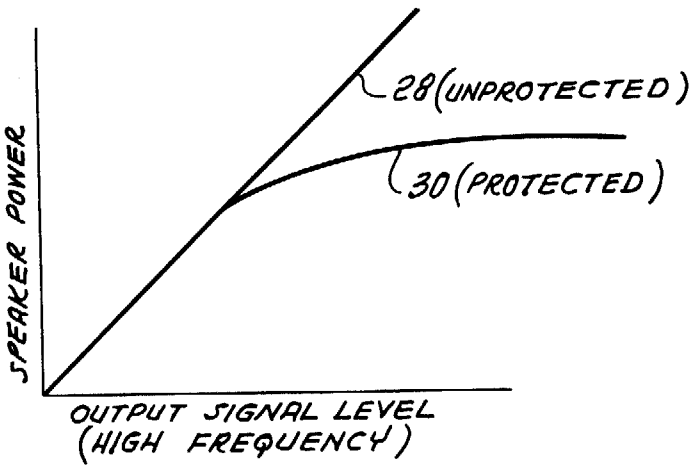
FIG. 2 is a graph illustrating the behavior of the high frequency speaker section.

FIG. 2 illustrates the effect of the thermistor 26. Line 28 shows the usual linear relationship between output signal and speaker power dissipation that shows the danger of tolerable power levels being exceeded. The line 30 shows the compression effect of the thermistor 26. The relationship between output signal and speaker power dissipation is linear at the lower levels whereby the usual designed high-low balance between speaker sections is observed. However, at higher signal levels, a deviation from a linear relationship gradually occurs. Yet power nevertheless increases with increasing signal, but the rate of increase continually reduces. There is no abrupt non-musical cutoff; the high frequency section produces output at all signal levels. The low frequency section or sections are entirely unaffected. Increasing the power handling capabilities of the high frequency section furthermore is not musically desirable.

Intending to claim all novel, useful and unobvious features shown or described, I make the following

1. In an audio system for an electronic musical instrument including a composite generating means and a multiband speaker system:

(a) a high frequency speaker section;

(b) a low frequency speaker section;

(c) a divider network having an input and having a plurality of spectrally distinct outputs respectively connected to said speaker sections;

(d) power sensing means continuously associated only with said high frequency section and operative to compress the high frequency response as a gradual function of increased power level;

(e) said high frequency speaker section being operative at all power levels to translate electrical impulses into sound.

2. The multiband speaker system as set forth in claim 1 in which said power sensing means is a thermistor serially connected to said high frequency section, said thermistor having low thermal inertia characteristics.

3. In a multiband speaker system:

(a) means for generating electrical impulses corresponding to musical sound in a wide spectral band, and including an automatic section and a manual section having overlapping spectral ranges at the high end;

(b) each of said generating sections being capable of producing high power output at said high spectral end whereby very high power output at said high end occurs;

(c) a common power amplifier fed by said generating sections;

(d) a high frequency speaker section;

(e) a low frequency speaker section;

(f) a crossover network for connecting the power amplifier to said speaker sections whereby said speaker sections translate said electrical impulses into sound within the spectral characteristics of said speaker sections respectively; and (g) thermistor means of low thermal inertia characteristic serially associated only with said high frequency section and operative to compress the high frequency response as a graduated function of power level whereby coincidence of high power output of both of said generating sections at said high spectral end is ineffective to overload said high frequency speaker section while a high-low balance is otherwise maintained.

* * * * *